United States Patent [19]

Schlaeger

[11] 4,221,330

[45] Sep. 9, 1980

[54] CENTER BUTT TIE CONNECTOR

[75] Inventor: Gary D. Schlaeger, Columbia Heights, Minn.

[73] Assignee: Burlington Northern Inc., St. Paul, Minn.

[21] Appl. No.: 873,004

[22] Filed: Jan. 27, 1978

[51] Int. Cl.[2] ..... E01B 3/46

[52] U.S. Cl. ..... 238/31; 52/227; 52/731; 144/310 R; 238/34; 238/35; 238/286

[58] Field of Search ..... 238/29, 30, 31, 34, 238/35, 50, 83, 84, 109, 117, 118, 85, 87, 91, 286, 110–116; 29/403, 428; 144/310 R; 52/721, 731, 606, 227

[56] References Cited

U.S. PATENT DOCUMENTS

| | | | |
|---|---|---|---|
| 264,162 | 9/1882 | Hudson | 238/32 |
| 721,745 | 3/1903 | Robbins | 238/32 |
| 971,353 | 9/1910 | Brayton et al. | 52/731 |
| 985,483 | 2/1911 | Wetherell | 238/31 |
| 1,043,621 | 11/1912 | McComas | 238/286 X |
| 1,169,158 | 1/1916 | Houghton | 238/286 X |
| 1,360,594 | 11/1920 | Snyder | 238/286 X |
| 1,366,385 | 1/1921 | Igarashi | 238/286 |
| 1,436,847 | 11/1922 | Wilson | 238/117 X |
| 3,948,010 | 4/1976 | Sonneville | 238/85 |
| 3,969,871 | 7/1976 | Ewers | 52/721 |
| 4,109,440 | 8/1978 | Bill | 52/721 |

FOREIGN PATENT DOCUMENTS

| | | | |
|---|---|---|---|
| 1049889 | 2/1959 | Fed. Rep. of Germany | 238/85 |

*Primary Examiner*—Randolph A. Reese

*Attorney, Agent, or Firm*—Merchant, Gould, Smith, Edell, Welter & Schmidt

[57] ABSTRACT

A compound cross tie for railroad use, the method of making it, and a joiner used therein. The cross tie comprises a pair of wooden end members connected axially by the joiner, and a compressional member traversing the entire assembly: means are provided to prevent relative rotation among the various components.

1 Claim, 6 Drawing Figures

CENTER BUTT TIE CONNECTOR

BACKGROUND OF THE INVENTION

This invention relates to the field of construction and maintenance of railroad road beds, and particularly to a method for producing usable sleepers or crossties, at economically justifiable cost, from materials usually of value to railroads only as salvage, and also to the compound crossties so produced.

A crosstie is a structural member of the roadbed to the top surface of which rails are secured extending along the roadbed. It is placed upon or embedded in the aggregate ballast to maintain the guage or spacing between the rails and the alignment of the rails, and to distribute the bearing load to the ballast.

Historically, crossties have been produced in this country by sawing or hewing logs of proper length into various sizes ranging in cross section from 5"×5" to 10"×12", and in length from 8 feet, for right-of-way use, to 12 feet, for use at switch turnouts, bridges, etc. Although more expensive, oak is the preferred material for crossties, but other woods are also usable.

After a period of use, crossties become weak, due to deterioration from mechanical wear at the points where the rail is affixed, to longitudinal checking or mechanical failure of the wood, or to attack from biological organisms, so that the crossties can no longer perform their functions, and must be replaced.

Replacement of crossties was first accomplished by pulling the spikes holding the rails to the wood and laterally pulling the entire tie from under the rail, to be replaced with a new tie, after which elevation, alignment, and gauge were reestablished.

This replacement method, accomplished basically by manual labor, resulted in an accumulation of old ties which, although no longer useful for their intended purpose, were still useful as fence posts, for landscape cribbing, etc., and thus had some salvage value.

As labor became more expensive and mechanical technology improved, new track maintenance machines were developed to accomplish removal and replacement of crossties more efficiently and productively. To minimize the amount of readjustment to elevation, alignment, and gauge, it was found to be more efficient to cut the ties into three pieces, while still in place in the roadbed, by means of vertically oscillating saw blades positioned just within the rails, thus producing three pieces of wood. The center section is referred to as the center butt, and the outer sections are referred to as field ends. These sections are too short to have even the salvage value referred to above for entire used crossties, and disposition of these pieces along the right-of-way, as by burning or burial, has disadvantages and in some areas has been prohibited, so it has become necessary to pick up these butts and ends after removal from the roadbed and transfer them, at significant cost, for disposition at suitable landfill areas usually some distance from their site of removal.

Currently, about 26 million crossties are removed annually in the United States, at an average of 32 board feet per crosstie—which represents 832 million board feet of tie material, calling for about 1.4 billion board feet of standing timber. A principal objective of this invention is to reduce so great a demand for standing timbers to be made into crossties.

In the railroad industry, it is the practice to scrap rolling stock when by damage or age it can no longer economically justify repairs. Regularly, steel plate is salvaged from car sides, and brake pipe material and brake rod material is also salvaged, presently for recycling back into steel.

The present invention contemplates constructing usable compound crossties from the scrap steel plate, rod, and pipe just described and the center butts from tie replacement operations. Field ends are generally unusable for the purpose of this invention, but about half the center butts are so usable, two being needed for one complete compound tie.

SUMMARY OF THE INVENTION

The invention comprises a method of manufacturing compound crossties, and the structure of a crosstie so made. Such a crosstie comprises an assembly of two wooden end members, a steel joiner, and a compression member traversing the above members to assemble them into a unitary structure. The joiner, in turn, comprises a pair of end plates extending transverse to an axis, an axial tubular member extending between and beyond the end plates, and reinforcing web means secured to the end plates and the tubular member in unitary relation.

Various advantages and features of novelty which characterize my invention are pointed out with particularity in the claims annexed hereto and forming a part hereof. However, for a better understanding or the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 1:
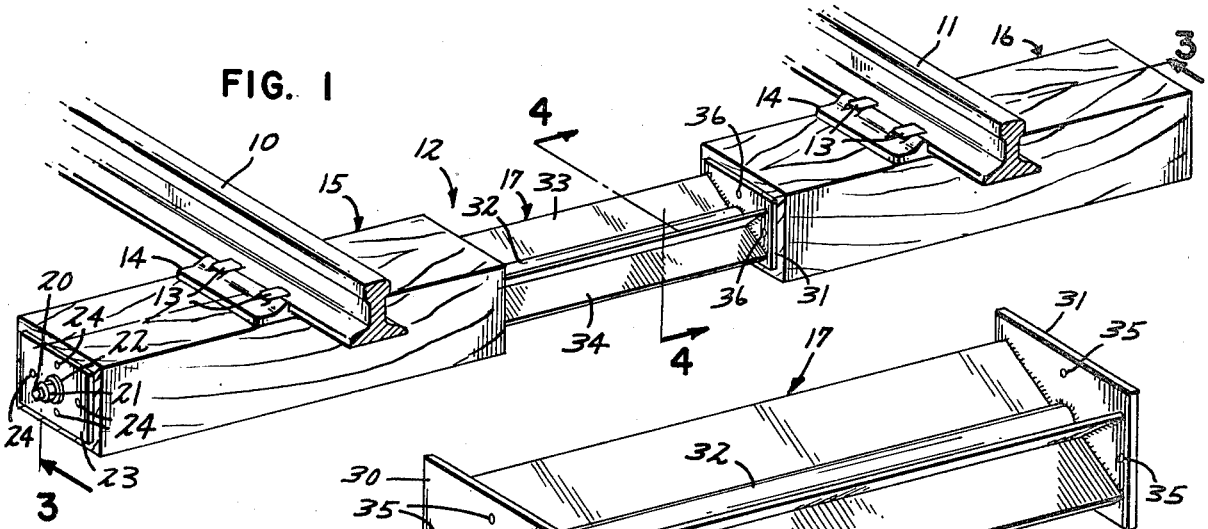
FIG. 1 is a perspective view of a compound tie according to my invention, shown in its intended relation to a pair of rails.

The roadbed of a railroad comprises a pair of rails maintained in elevation, alignment, and gauge by being secured to supporting crossties by spikes overlying the base of the rail and passing through tie plates into the wood of the crosstie. Ordinarily the crossties rest on and are embedded in ballast of crushed rock or cinders. FIG. 1 shows a fragment of such a roadbed schematically: rails 10 and 11 are secured to a compound crosstie 12 by spikes 13 passing through tie plates 14 into the end members 15 and 16 of the crosstie, which are of wood and are spaced by a joiner 17, being maintained in assembly therewith by a compressional member or tie rod 20 threaded at its ends to receive nuts 21 and washers 22 which bear against suitable outer plates 23 secured to the outer surfaces of members 15 and 16 by nails 24 passing through holes 25 provided in the plates.

Figure 2:
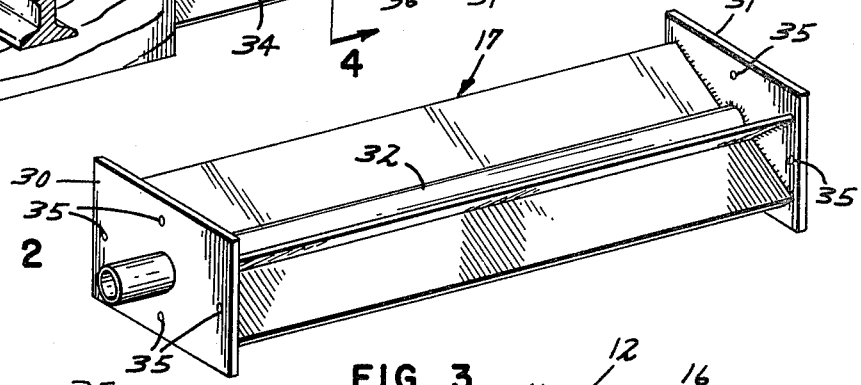
FIG. 2 is a view in perspective of a joiner according to my invention, to a larger scale.
Figure 3:
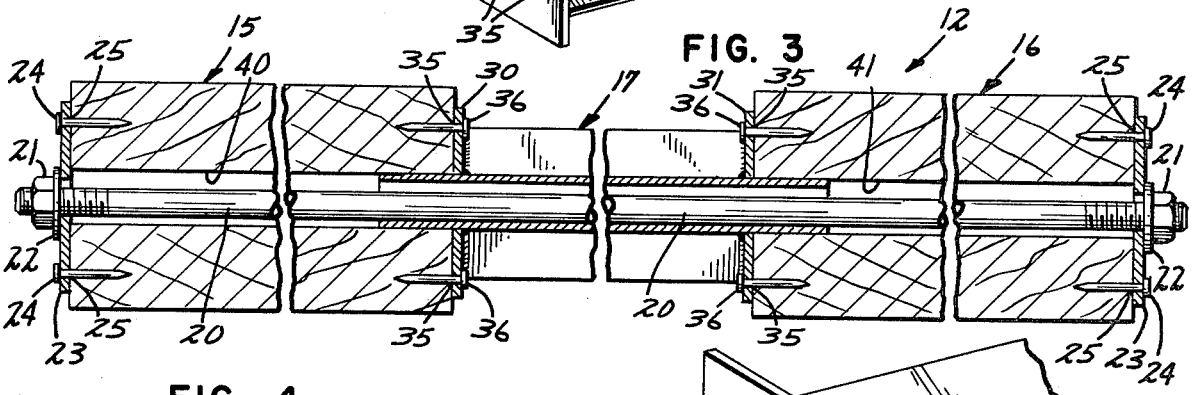
FIG. 3 is a longitudinal section of the structure of FIG. 1 to a larger scale, the section being taken along the line 3—3 of FIG. 1.
Figure 4:
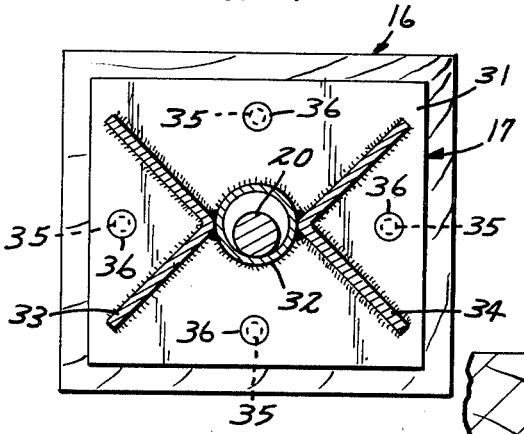
FIG. 4 is a transverse sectional view of the joiner, taken along the line 4—4 of FIG. 1, to a larger scale.

As shown in detail in FIGS. 2 and 4, joiner 17 is a steel weldment and comprises a pair of inner end plates 30 and 31, a central tubular member 32, and reinforcing means in the form of a pair of interior braces 33 and 34. Plates 30 and 31 extend transverse to the axis of member 32, which extends between and beyond the plates and is welded thereto. Braces 33 and 34 are of steel plate formed into right-angle configurations: they are welded at their ends to inner plates 30 and 31, and along their apices to member 32. Plates 30 and 31 are provided with holes 35, as in plates 23, to pass nails 36 driven into the inner ends of members 15 and 16: these nails prevent rotation of members 15, 16, and 17 relative to one another about the axis of member 32.

Plates 23, 30, and 31 are sheared and punched from salvage material, braces 33 and 34 are sheared and bent from the same material, and member 32 is cut from salvage pipe, so that the only costs for materials for joiner 17 are the salvage values of the materials and the labor and machine costs for cutting, forming and welding it.

Members 15 and 16 are bored centrally lengthwise, as shown at 40, 41, to receive the ends of member 32 which extend beyond plates 30 and 31. As also clearly shown, tie rod 20 need not be a close fit in the bores or in member 20 and plates 23. The only requirements for this rod are that it be long enough to extend from end to end of the assembly, and that it be strong enough to resist deformation of the complete assembly when in use.

Figure 5:
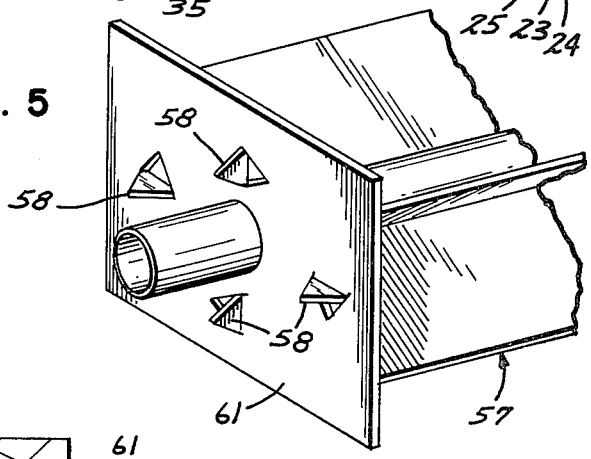
FIG. 5 is a fragmentary view in perspective of one end of a modified joiner.
Figure 6:
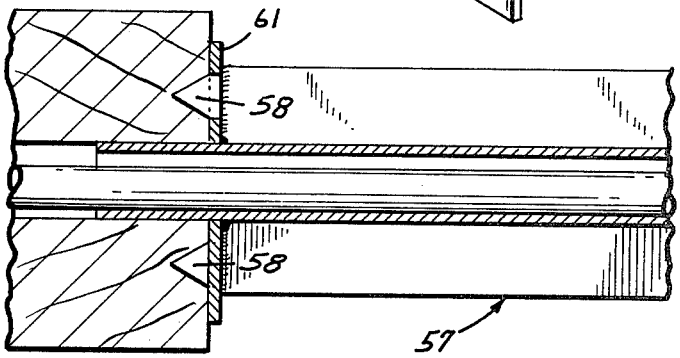
FIG. 6 is a fragmentary view similar to a portion of FIG. 3 but to a larger scale, and showing the embodiment of FIG. 5.

The joiner 57 of FIGS. 5 and 6 differs from that just described only in substituting for holes 35 a plurality of triangular spuds 58 struck out from the metal of plate 61 and arranged to extend therebeyond when the joiner is assembled, so that the spuds 58 penetrate into the wood of members 15 and 16 and prevent the relative rotation described in connection with nails 36.

By way of illustration only, dimensions and procedural steps for making compound crossties according to the invention are given below. From sections of salvaged car side plate material are die-stamped and punched the 5"×6" plates 23, 30, 31. Plates $5\frac{1}{2}''\times21\frac{5}{8}''$ are sheared and bent at right angles along their longer axes to form the internal braces 33 and 34. Sections of brake pipe 26" long and brake rod 9 feet long are cut, and the rod ends are threaded for $2\frac{1}{2}''$ at each end. Braces 33, 34 are centered on and welded to tubular member 32, and inner end plates 30, 31 are welded to the ends of the internal braces and to the tubular member. This work is done at a car salvage facility.

The center butts, gathered from wherever tie replacement is being done, are transported to the facility just named and are graded for soundness. Sound butts are processed as will now be itemized: no preservative treatment is applied at this time:

1. passage through high pressure debarking jets of water to remove dirt, stones, and foreign matter;
2. passage through opposing sets of wire brush rolls to mechanically pick out foreign matter not removed in step 1;
3. passage through a double-end trimmer to remove rough edges resulting from field sawing and reduce the length to 40";
4. passage through a two-arbor abrasive planer to resurface the "wide" sides, top and bottom;
5. drilling coaxially in two successive operations from opposite ends;
6. assembly
   (a) insert joiner between two reprocessed center butts;
   (b) insert tie rod;
   (c) bolt on outer plates with impact wrenches; and
   (d) insert nails with pneumatic nailing guns; and
7. adze and drill for tie plate acceptance in a conventional tie adzing and drilling machine.

It has been determined that the procedures described above result in usable compound crossties at economically justifiable prices: this is advantageous because the supply of suitable standing timber of adequate size is dwindling, and the cost of crossties is multiplying, as is the cost for seasoning and treating wood ties and maintaining an adequate inventory. By practicing my invention, for each million ties replaced, 250,000 compound ties can be constructed, reducing by 8 million board feet the demand for tie material and by about 13.4 million board feet the demand for standing timber.

From the foregoing, it will be evident that I have invented a new and useful compound crosstie for railroad use, and a new process for making such crossties out of material having at most scrap or salvage value.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A compound cross tie for use in railway roadbeds, consisting of a pair of wooden end members each having a load bearing surface, a pair of opposite ends, and a bore extending longitudinally therethrough from end to end;

a wholly metallic joiner including a pair of end plates extending transversely of and spaced along an axis, a tubular member extending axially between said end plates and therebeyond for a distance which is short compared to the lengths of said wooden members, and reinforcing web members of angular cross section secured along their apices to diametrically opposite sites along said tubular member, and at their ends to said end plates, said tubular member being dimensioned to fit in the bores in said wooden members at first ends thereof;

means, including pressure plates at second ends of said wooden members and a compression member passing loosely through said tubular member, said bores, and said pressure plates and acting against said pressure plates, for retaining said wooden members in assembled abutting relation to said end plates of said joiner, while enabling longitudinal flexibility of said cross tie when assembled and so improving the distribution of weight from said cross tie to a supporting roadbed;

and means preventing relative rotation of said wooden members about said axis, with respect to said plates, in response to a load moving across said load-bearing surface.

* * * * *